US012607017B2

(12) United States Patent
Wilson et al.

(10) Patent No.: US 12,607,017 B2
(45) Date of Patent: Apr. 21, 2026

(54) SELF-COILING APPARATUS

(71) Applicant: ROSWELL CANADA INC., Acheson (CA)

(72) Inventors: Darrick J. Wilson, Edmonton (CA); Matt Lane, Edmonton (CA)

(73) Assignee: ROSWELL CANADA INC., Acheson (CA)

( * ) Notice: Subject to any disclaimer, the term of this patent is extended or adjusted under 35 U.S.C. 154(b) by 476 days.

(21) Appl. No.: 18/120,504

(22) Filed: Mar. 13, 2023

(65) Prior Publication Data

US 2023/0287688 A1 Sep. 14, 2023

Related U.S. Application Data

(60) Provisional application No. 63/318,895, filed on Mar. 11, 2022.

(51) Int. Cl.
*E04F 10/06* (2006.01)
*B63B 17/02* (2006.01)

(52) U.S. Cl.
CPC ..... *E04F 10/0659* (2013.01); *B63B 17/02* (2013.01)

(58) Field of Classification Search
CPC ..... B63B 17/02; E04F 10/0659
See application file for complete search history.

(56) References Cited

U.S. PATENT DOCUMENTS 2,826,523 A * 3/1958 Blaszkowski ..... F16L 59/021 280/DIG. 4
4,433,711 A * 2/1984 Lew ..... E06B 9/40 160/241
4,480,652 A * 11/1984 Gooch ..... B63B 17/02 160/238
4,848,437 A * 7/1989 Laniado ..... E06B 9/40 428/476.1
4,929,016 A * 5/1990 Kastanis ..... B60J 11/02 296/136.03
5,176,452 A * 1/1993 Stern ..... B65D 33/30 63/11
5,176,774 A 1/1993 Laniado et al.
5,294,167 A * 3/1994 Yu ..... B60J 11/02 242/372
5,353,826 A * 10/1994 Davis, Sr. ..... B60J 7/102 296/159
5,373,942 A * 12/1994 Weder ..... B29C 51/08 53/399
5,443,923 A * 8/1995 Laniado ..... E06B 9/40 160/237
5,845,804 A * 12/1998 Prescott ..... B65D 81/389 220/739

(Continued)

FOREIGN PATENT DOCUMENTS

WO 2015057046 A1 4/2015

*Primary Examiner* — Joshua E Freeman
(74) *Attorney, Agent, or Firm* — Timothy H. Van Dyke; Wolter Van Dyke Davis, PLLC

(57) ABSTRACT

An apparatus, including: a Bimini assembly (100) with a fixed portion (104) and a retractable portion (106); a coil spring (110) secured to the retractable portion and configured to urge the retractable portion to coil when the coil spring is not in a fully extended position; and a stabilizing feature configured to selectively hold the retractable portion in a retractable portion fully extended position.

20 Claims, 12 Drawing Sheets

(56) References Cited

U.S. PATENT DOCUMENTS

| | | | | |
|---|---|---|---|---|
| 6,978,732 | B1 * | 12/2005 | Jirak | B63B 17/02 114/364 |
| 7,093,558 | B1 * | 8/2006 | Mandanici | B63B 17/02 114/361 |
| 8,523,010 | B2 | 9/2013 | Mompel et al. | |
| 8,857,366 | B2 | 10/2014 | Russinkoff | |
| 10,590,699 | B2 | 3/2020 | Chen | |
| 11,100,821 | B1 * | 8/2021 | Peloquin | G09F 15/0037 |
| 12,208,864 | B2 * | 1/2025 | Sevy | B63B 17/02 |
| 2002/0053313 | A1 * | 5/2002 | Murphy | B63B 17/02 114/361 |
| 2004/0049958 | A1 * | 3/2004 | Eisen | G09F 17/00 40/514 |
| 2004/0238089 | A1 * | 12/2004 | Li | B60J 11/00 296/136.13 |
| 2005/0204994 | A1 * | 9/2005 | Miotto | B60J 7/04 114/361 |
| 2008/0011217 | A1 * | 1/2008 | Russikoff | B63B 17/02 114/361 |
| 2011/0290170 | A1 * | 12/2011 | Russikoff | B63B 17/02 114/361 |
| 2013/0206050 | A1 * | 8/2013 | Russikoff | B63B 17/02 114/361 |
| 2014/0130990 | A1 * | 5/2014 | Wong | B60J 1/2013 160/309 |
| 2018/0319461 | A1 | 11/2018 | Russikoff | |
| 2021/0323639 | A1 * | 10/2021 | Ward | B63B 17/02 |
| 2023/0125631 | A1 * | 4/2023 | Shotwell | B63B 34/00 114/361 |

* cited by examiner

SELF-COILING APPARATUS

FIELD OF THE INVENTION

The present invention relates to a barrier apparatus configured to selectively self-coil.

BACKGROUND OF THE INVENTION

Industry has developed a wide variety of covers that form environmental and mechanical barriers that may be used to protect people and/or items. Storage of barriers not being used can pose a challenge, particularly where storage space is limited. Consequently, there remains room in the art for improvement.

BRIEF DESCRIPTION OF THE DRAWINGS

The invention is explained in the following description in view of the drawings that show.

DETAILED DESCRIPTION OF THE INVENTION

The present inventor has developed a unique and innovative self-coiling barrier that mitigates storage problems associated with conventional barriers. Specifically, the self-coiling cover can retain itself in position but out of the way as a coil when in a stored configuration. This eliminates the need to remove and/or otherwise store the cover when not in use. Barriers such as this have been used in a variety of ways to provide protection from the sun, wind, and rain. A nonlimiting example of such a barrier is a Bimini cover. However, the disclosure is not limited to Bimini covers.

Figure 1:
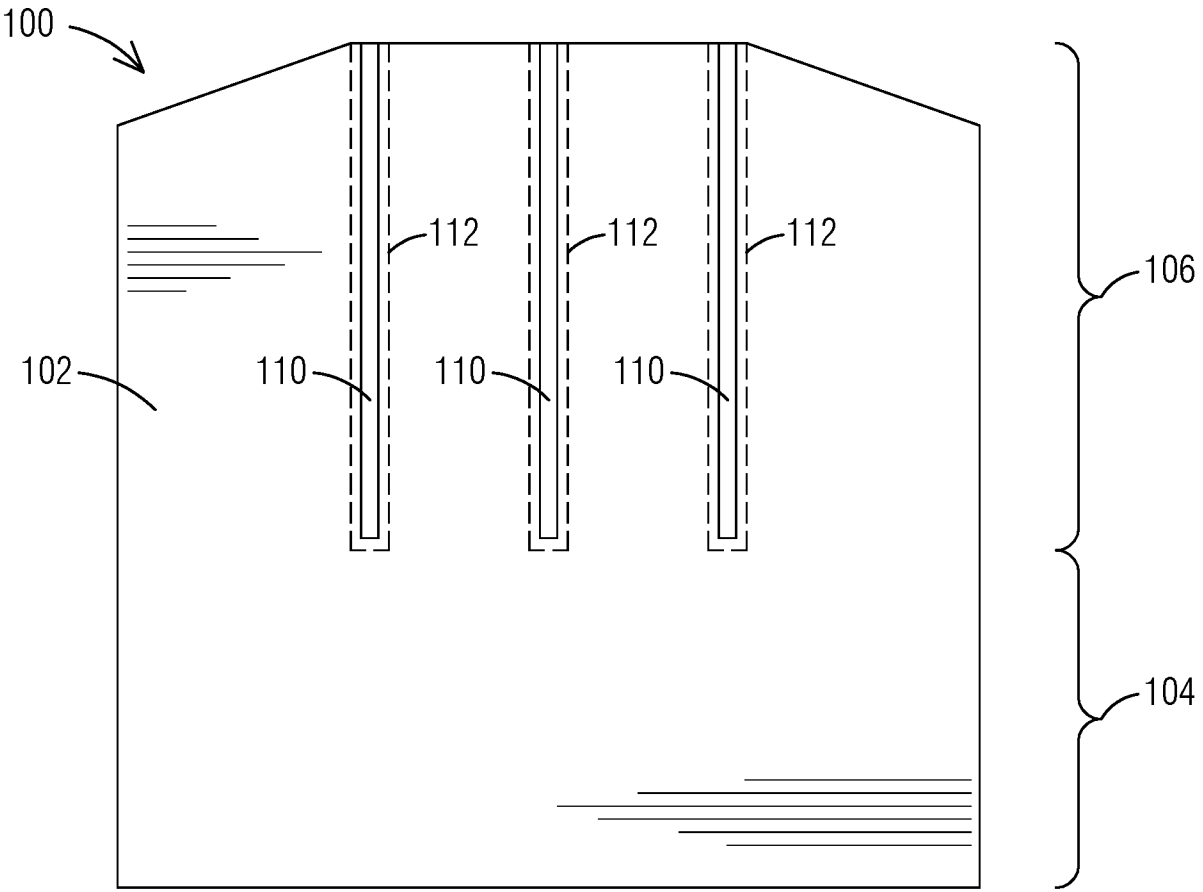
FIG. 1 is a top view of an example embodiment of a self-coiling cover disclosed herein.

FIG. 1 is a top view of an example embodiment of a self-coiling cover disclosed herein. In this example embodiment, the self-coiling cover is embodied as a Bimini assembly 100 with a Bimini cover 102 secured to a frame (not visible in FIG. 1). The Bimini cover 102 may be composed of any suitable flexible substrate capable of being rolled into a coil.

In various example embodiments disclosed herein, the Bimini assembly 100 includes a fixed portion and a retractable portion. In the example embodiment of FIG. 1, the fixed portion includes a first portion 104 of the Bimini cover 102 and the retractable portion includes a retractable portion 106 of the Bimini cover 102 that secures to the frame. However, as disclosed below, the fixed portion and retractable portions can be configured differently. For example, the retractable portion of the assembly can be the entire Bimini cover, as opposed to a portion of the Bimini cover as in FIG. 1. Likewise, the fixed portion can include the first portion of the Bimini cover and the retractable portion can include a flap of the Bimini cover that secures to the first portion of the Bimini cover or to the frame.

The frame may take any shape suitable for supporting the Bimini cover 102, such as a tubular-member framework and the like.

A self-coiling coil spring 110 is secured to the retractable portion 106 and configured to urge the retractable portion 106 to coil when the coil spring 110 is not in a fully extended position like that shown in FIG. 1. In this example embodiment, the coil spring 110 is disposed within a pocket 112 in or on the Bimini cover 102. Alternately, or in addition, the coil spring 110 may be adhered to or otherwise secured to the Bimini cover 102. Any association between the coil spring 110 and the Bimini cover 102 that curls the Bimini cover 102 with the coil spring 110 is acceptable.

The retractable portion 106 of the Bimini cover 102 may be held in the retractable portion fully extended position shown in FIG. 1 via a stabilizing feature. In example embodiments, the stabilizing feature can be a connection between the retractable portion and the fixed portion, such as a mechanical connection (hook and loop, snaps, zippers etc.). Alternately, or in addition, the stabilizing feature may be a feature present in (or characteristic of) the coil spring itself. In such example embodiments, the stabilizing feature is part of a design of the coil spring that is configured to lock the coil spring in a coil spring fully extended position once the coil spring is fully extended (i.e., a first stable position). This stabilizing feature will also unlock the coil spring from the coil spring fully extended position when such a coil spring is forcefully collapsed, after which the coil spring will coil into its second stable position. In example embodiments with such a bistable coil spring, when the coil spring is locked into the coil spring fully extended position, the coil spring holds the Bimini cover in a Bimini cover fully extended position. It is possible for the stabilizing feature in example embodiments to include both an external connection and a bistable coil spring.

Consequently, the coil spring 110 in FIG. 1 may or may not be a bistable coil spring. If the coil spring 110 is not a bistable coil spring 110, the coil spring 110 will always urge the Bimini cover 102 to coil. An external mechanical connection will be needed to keep the Bimini cover in the fully extended Bimini cover position shown in FIG. 1. If the coil spring 110 is a bistable coil spring, then the external mechanical connection is not required to keep the Bimini cover in the fully extended Bimini cover position shown in FIG. 1. However, an external mechanical connection may still be used with a bistable coil spring to, for example, hold the Bimini cover 102 in place against the wind etc.

While the coiling nature of the Bimini cover 102 disclosed herein is achieved via a self-coiling spring, the coiling nature can be achieved in other ways. For example, two sheets can be laminated together, where one sheet is pre-stretched prior to being laminated to the other. A Bimini cover could incorporate these laminated sheets. Such a Bimini cover could function similar to a coil spring that is not a bistable coil spring and hence would require an external mechanical connection to keep the Bimini cover in the Bimini cover fully extended position.

Figure 2:
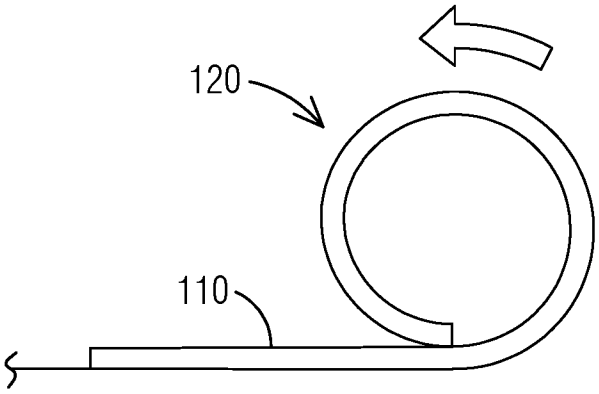
FIG. 2 to FIG. 4 show an example embodiment of a self-coiling coil spring of the cover of FIG. 1.
Figure 3:
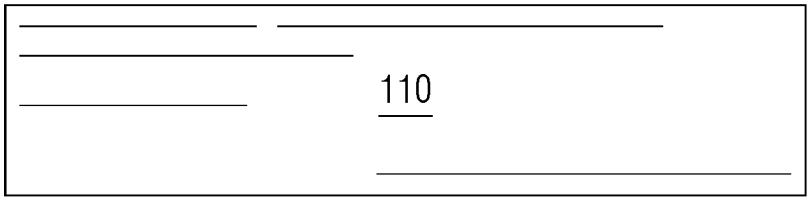
Figure 4:
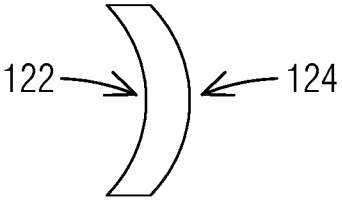

FIG. 2 shows the coil spring 110 of FIG. 1 forming a coil 120 moving from right to left as the coil spring 110 coils. FIG. 3 shows the coil spring 110 of FIG. 2 from below. FIG. 4 shows a cross section of the coil spring 110 which reveals a concave side 122 and a convex side 124. In an example embodiment of a bistable coil spring, the concave side 122 and the convex side 124 extend the entire length of the coil spring 110 and their geometry locks the coil spring 110 in the coil spring fully extended position. A suitably chosen thickness of the coil spring 110 allows the shape of the coil spring 110 to be collapsed when the coil spring 110 is in the coil spring fully extended position, which causes the coil spring 110 to self-coil.

Figures 5A, 5B, 5C, 5D:
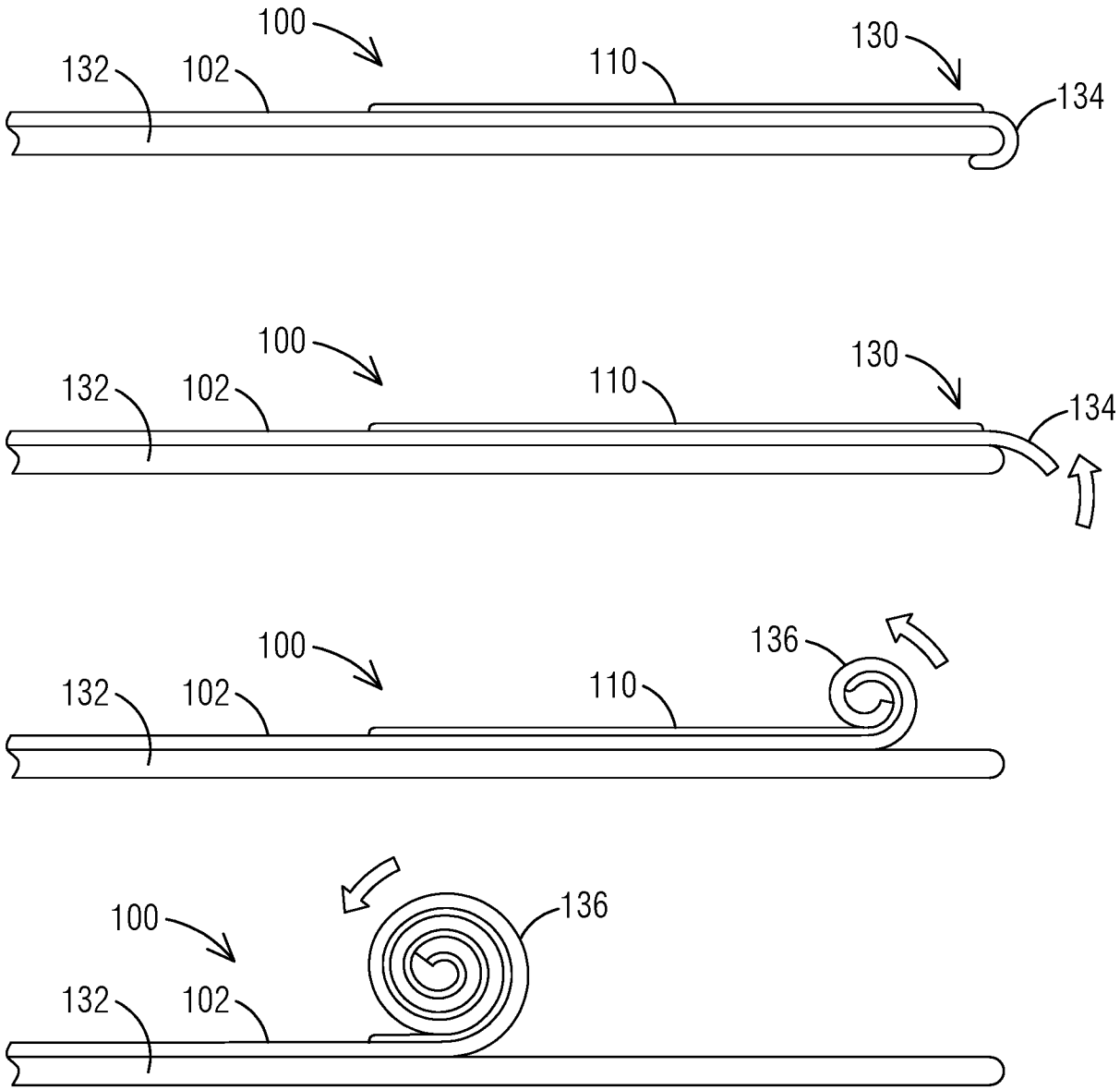
FIG. 5A to FIG. 5D show the Bimini assembly of FIG. 1 with the Bimini cover in positions ranging from being fully deployed to being fully retracted.

FIG. 5A to FIG. 5D show the Bimini assembly 100 of FIG. 1 with the Bimini cover 102 in positions ranging from being fully deployed to being fully retracted. In FIG. 5A, a tip end 130 of the Bimini cover 100 is secured to the frame 132 via a connection 134 (e.g., hook and loop, snaps, zipper etc.). To retract the Bimini cover 102, the connection 134 is released as shown in FIG. 5B. If the coil spring 110 is not a bistable coil spring, the coil spring 110 will constantly exert a coiling force on the Bimini cover 100, which the connection 134 simply overcomes. When the connection 134 is released, the coil spring 110 begins to coil and thereby forms a Bimini cover coil 136 that moves from right to left (as shown in FIG. 5C to FIG. 5D) until the Bimini cover 100 is in a Bimini cover fully retracted position as shown in FIG. 5D. If the coil spring 110 is a bistable coil spring, then once the connection 134 is released, the coil spring 110 is manually collapsed. Once collapsed, the coil spring 110 begins to coil and thereby forms the Bimini cover coil 136 that moves from right to left. Additional securement (e.g., straps) (not shown) may be used to secure the Bimini cover coil 136 when the coil is in the Bimini cover fully retracted position.

Figure 6B:
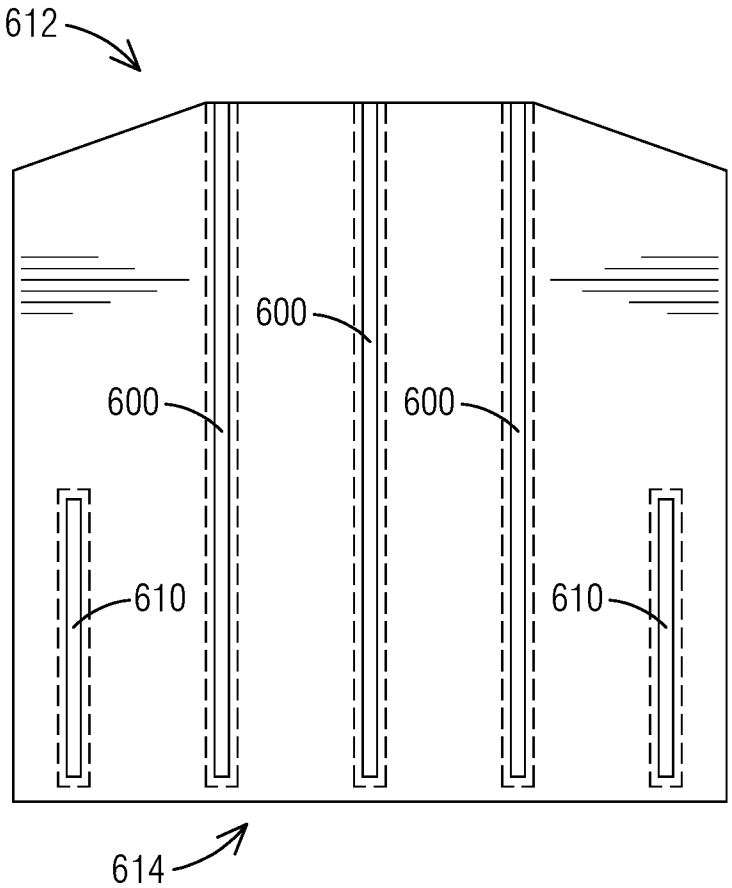
FIG. 6A to FIG. 6E show various alternate example embodiments of the self-coiling cover.
Figure 6A:
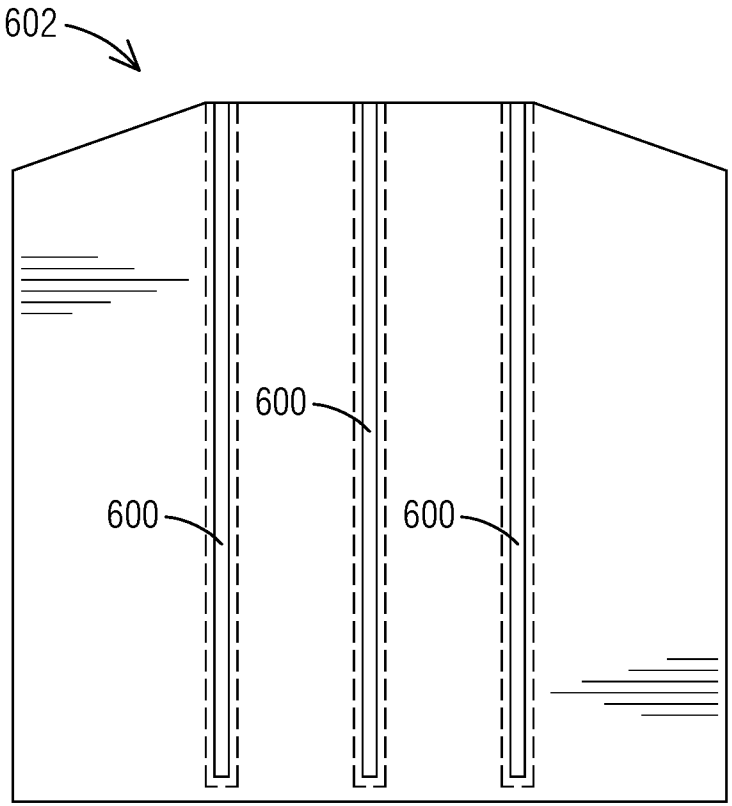

FIG. 6A to FIG. 6E show various alternate example embodiments of the self-coiling cover. In FIG. 6A, the coil springs 600 of the Bimini cover 602 extend the entire length of the Bimini cover 602. This enables coiling of the entire Bimini cover 602, albeit in the same manner as the example embodiment of FIG. 1.

The example embodiment of FIG. 6B is similar to that of FIG. 6A, but further includes second coil springs 610 in the Bimini cover 612. These second coil springs 610 are shorter than the coil springs 600 and are disposed closer to a base end 614 of the Bimini cover 612. This illustrates how the coil springs 600 and the second coil springs 610 can be staged to provide increasing coil force. Increasing coil force can be used in any situation deemed suitable. In the example embodiment of FIG. 6B, the second coil springs 610 will increase the coil force once a growing coil of a retracting Bimini cover 602 reaches the second coil springs 610. The second coil springs 610 thereby increase the coil force as the size of the coil and associated weight of the coil grows.

Figure 6D:
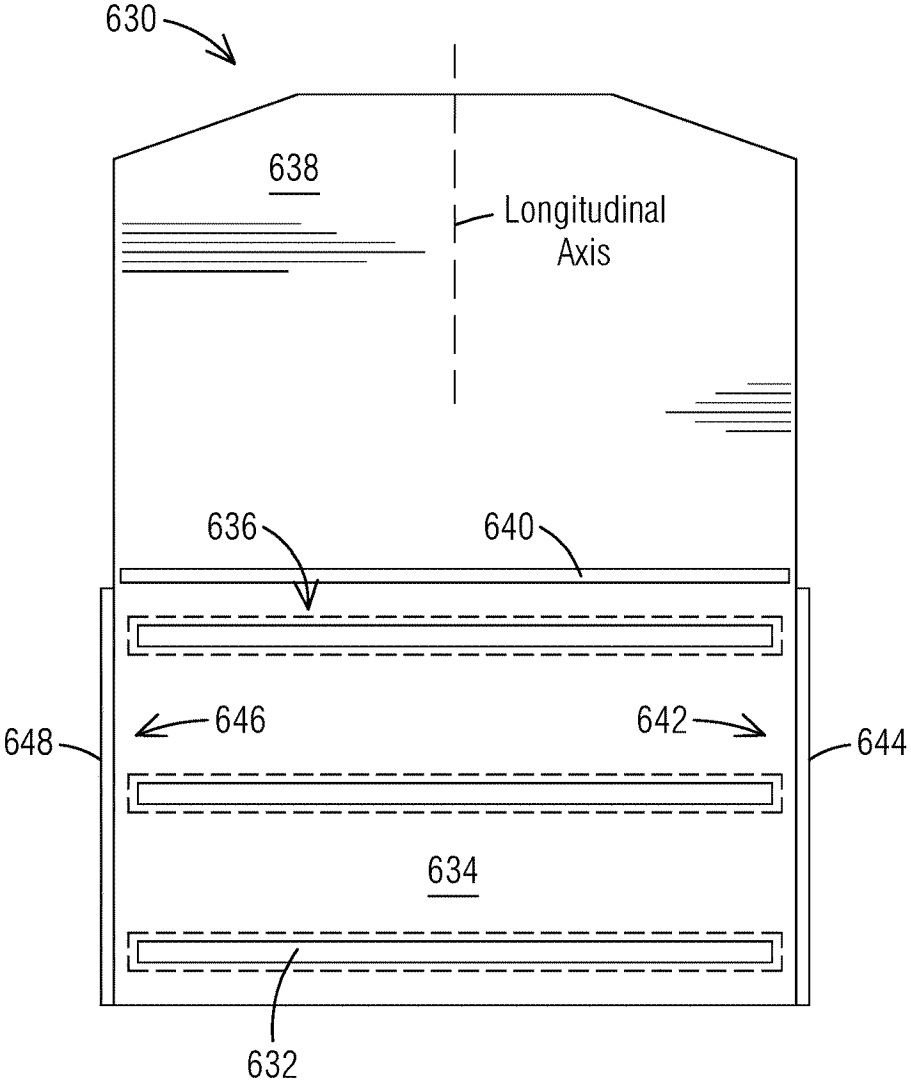
Figure 6C:
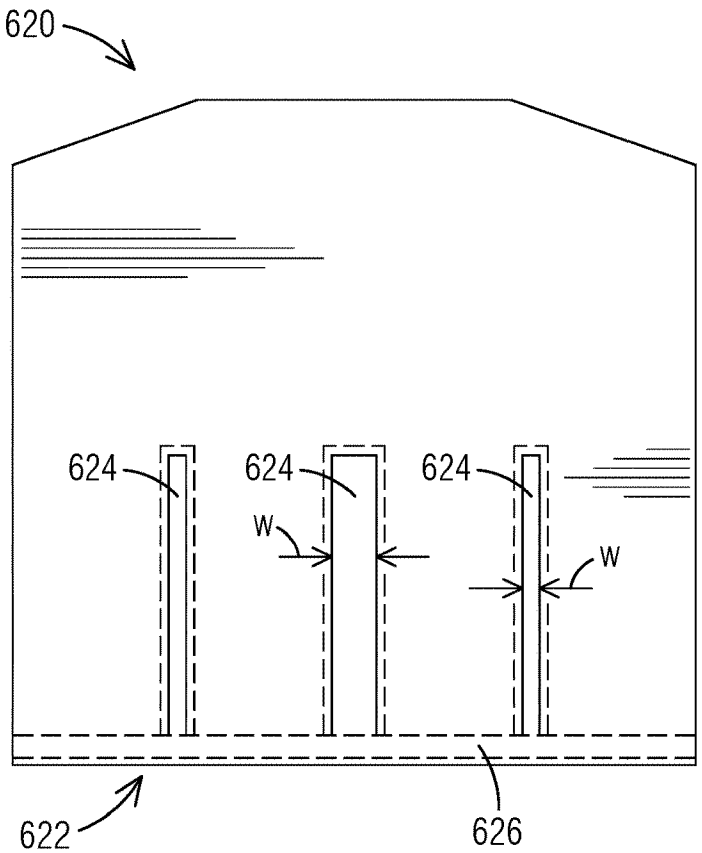

FIG. 6C shows an example embodiment of a Bimini cover 620 in which the base end 622 rolls forward. Coil springs 624 of varying widths W are used to create the required curl force. In this example embodiment, a rigid elongated element 626 (e.g., tube, bar) is disposed at the base end 622 and oriented perpendicular to the coil springs 624. The elongated element 626 is configured to hold the base end 622 straight which. If the coil springs 624 are bistable coil springs, the elongated element 626 may help prevent localized movement of the Bimini cover 620 in the base end 622 from inadvertently applying force to and collapsing one or more of the coil springs 624. The rigid elongated element 626 can function as a core to the coil formed when coiling the Bimini cover 620.

FIG. 6D shows an example embodiment of a Bimini cover 630 with coil springs 632 disposed laterally in a flap 634. A forward end 636 of the flap 634 is connected to a first portion 638 (e.g., the fixed portion) of the Bimini cover 630 via a connection 640 (e.g., hook and loop, snaps, zipper). A starboard end 642 is selectively/releasably connected to the frame via a starboard connection 644. A port end 646 is connected (optionally releasably connected) to the frame via a port connection 648. In this example embodiment, the flap 634 coils laterally relative to a longitudinal axis of the Bimini cover 630 (from right to left as shown in FIG. 6D). The connection 632 in the various example embodiments may form a water resistant or waterproof seal suitable to maintain an integrity of the Bimini cover 630 as a whole.

Figure 6E:
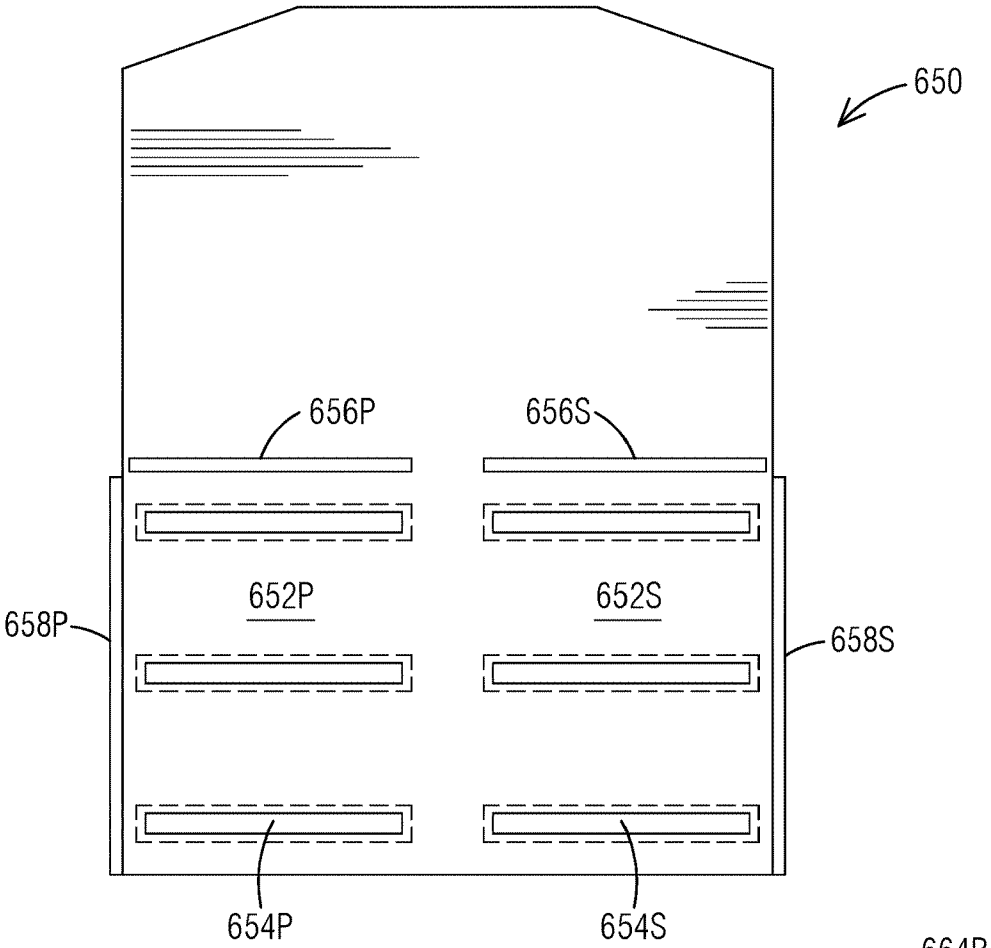

FIG. 6E shows an example embodiment of a Bimini cover 650 similar to that of FIG. 6D, but with two sets of flaps 652P, 652S and respective coil springs 654P, 654S and connections 656P, 656S and connections 658P, 658S. In this example embodiment, each flap 652P, 652S can be retracted and deployed independently of the other, which allows for greater flexibility in configuration.

Figure 7:
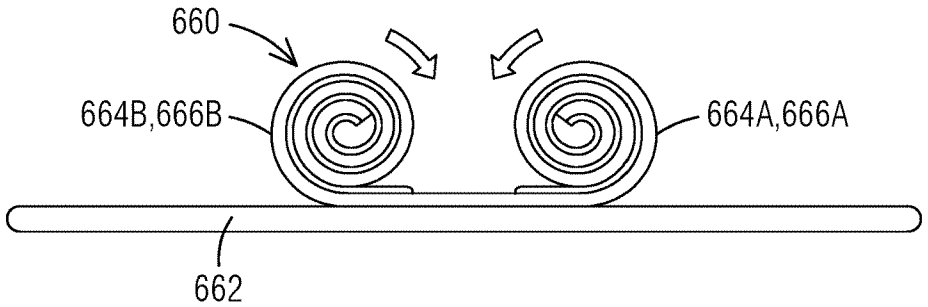
FIG. 7 shows an example embodiment of a self-coiling cover with two coils.
Figure 8A:
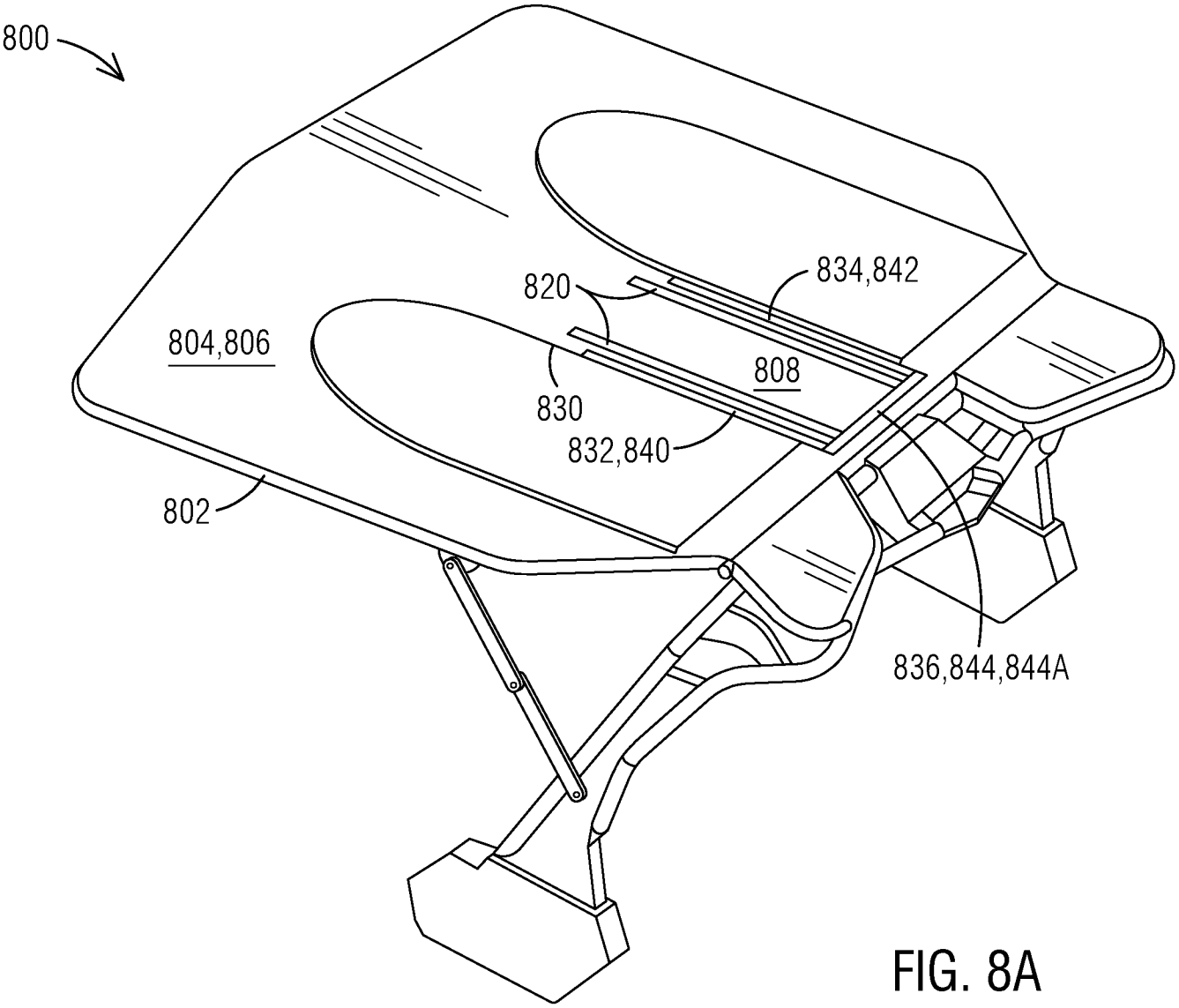
FIG. 8A to FIG. 8D show an alternate example embodiment of a self-coiling cover.
Figure 8B:
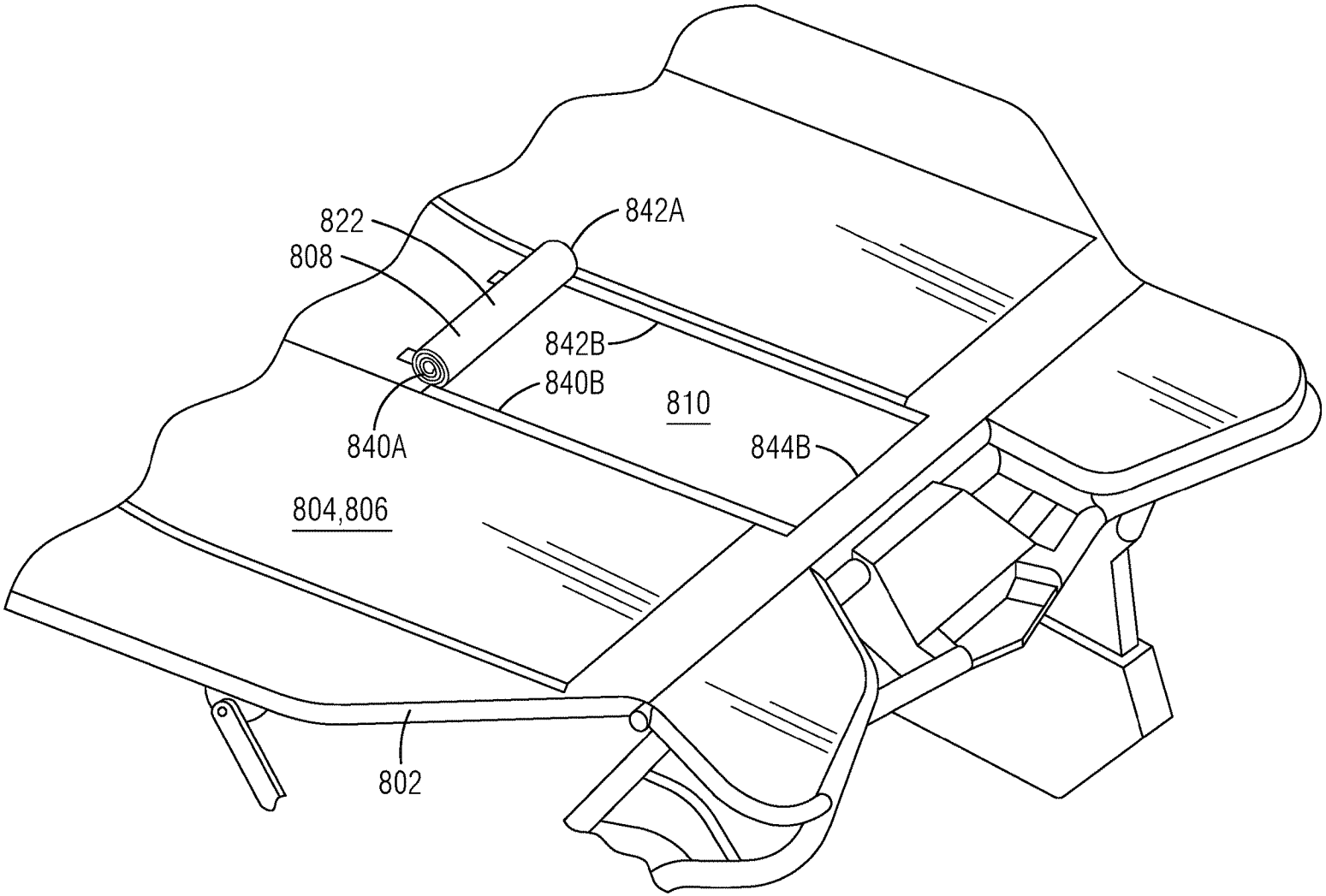
Figure 8C:
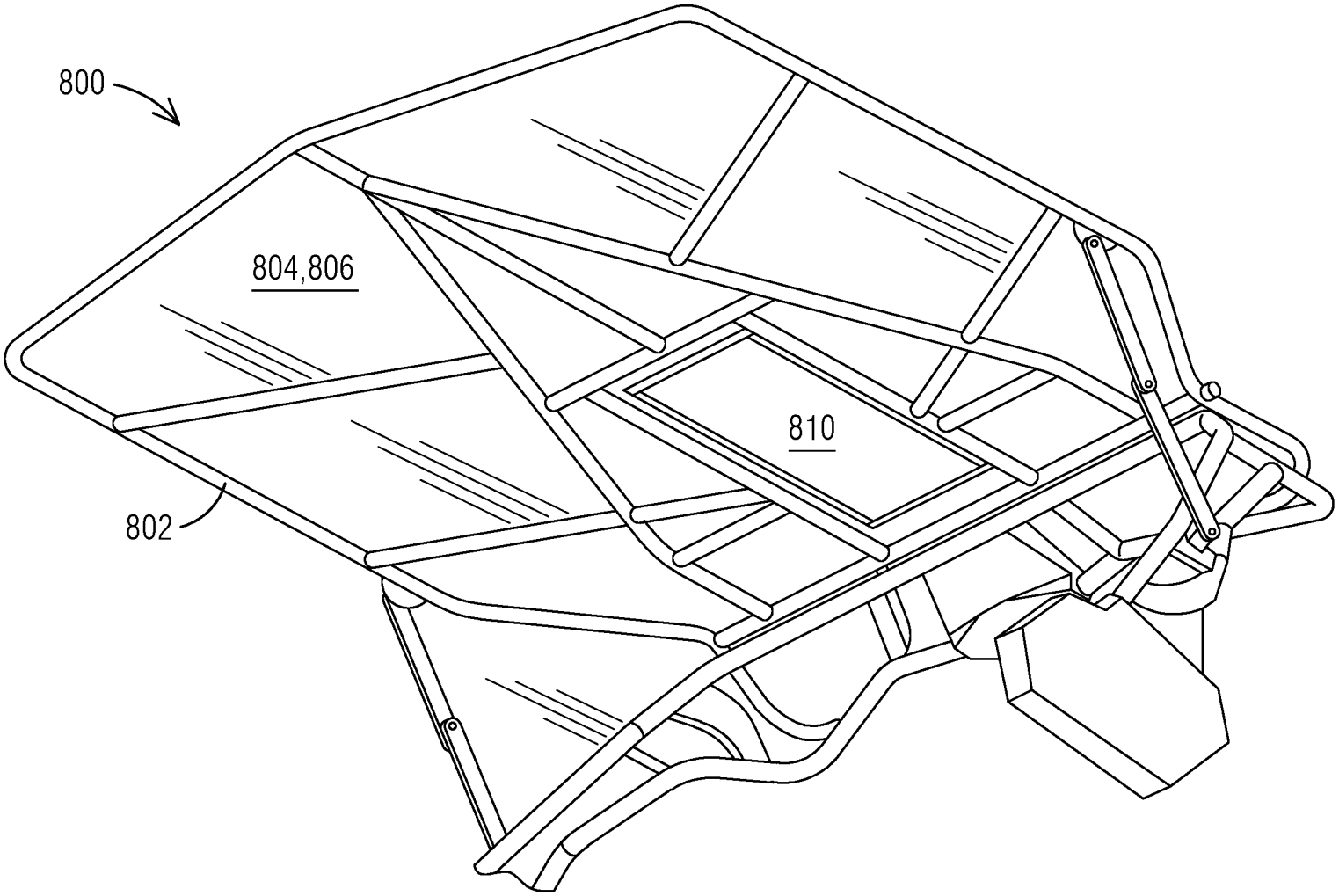
Figure 8D:
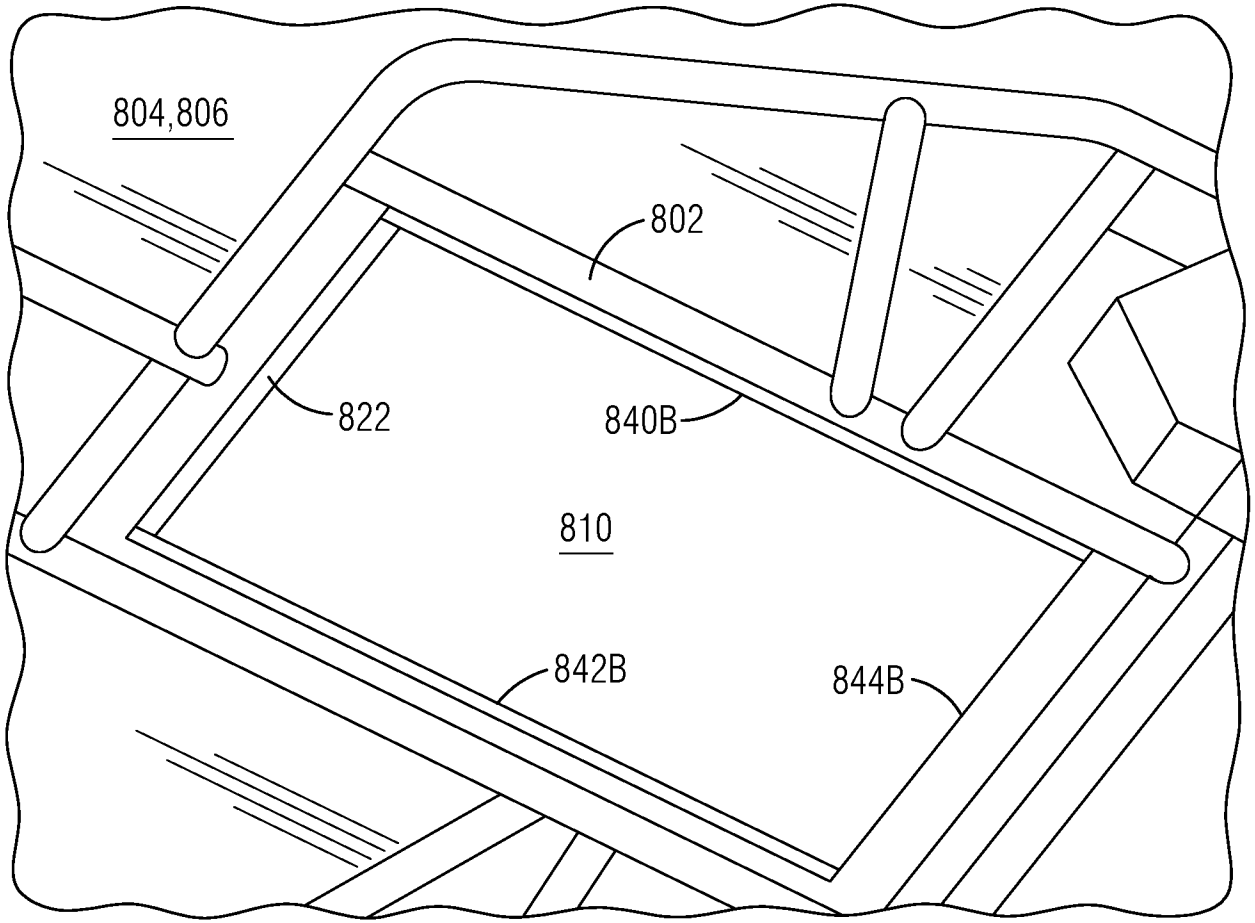

FIG. 7 shows an example embodiment of a Bimini cover 660 on a frame 662 in which two flaps 664A, 664B are retracted into respective rolls 666A, 666B. FIG. 7 could represent a rear view of the example embodiment of FIG. 6E. Likewise, FIG. 7 could be a side view of an example embodiment (not shown) in which a forward flap (e.g., of FIG. 1) and a rearward flap (e.g., of FIG. 6C) coil toward each other.

FIG. 8A to FIG. 8D show another alternate example embodiment of a cover assembly 800 including a frame 802 and a Bimini cover 804. The Bimini cover 804 includes a first portion 806 (the fixed portion) and a flap 808 (the retractable portion). In this example embodiment, the flap 808 functions similar to a sunroof. Optionally, an opening 810 present when the flap 808 is retracted is sized to permit a person to fit therein. This size can be advantageous for improved spotting/observing purposes, for access to a top side of the Bimini cover 804, and the like. Coil springs 820 are configured to coil the flap 808 into a coil 822.

A perimeter 830 of the flap 808 is connected to the first portion 806 and includes a first side 832, a second side 834, and a tip end 836. The first side 832 connects to the flap 808 via a first side connection 840. The second side 834 connects to the flap 808 via a second side connection 842. The tip end 836 connects to the flap 808 via a tip end connection 844. Each connection 840, 842, 844 includes respective connecting portions 840A 840B, 842A 842B, 844A 844B. The connections may include any connection suitable to connect the flap 808 to the first portion 806. Example connections include hook and loop, button/snaps, and zippers etc., and may form water resistant or waterproof seals. In this example embodiment, the stabilizing feature includes the first side connection 840, the second side connection 842, and the tip end connection 844. Using infinitely adjustable connections such as a zipper for the first side connection 840 and the second side connection 842 allows an infinite adjustment of the size of the opening 810 because the zippers can be drawn to any desired position and will overcome the spring coil force. This holds the coil 822 in any position along a travel length of the coil 822.

Figure 9A:
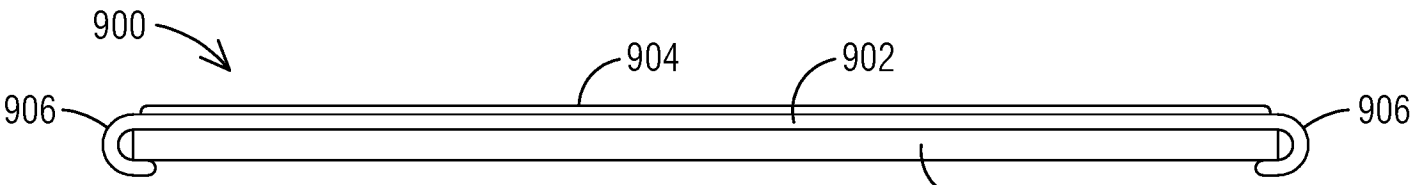
FIG. 9A to FIG. 9C show another alternate example embodiment of a self-coiling cover.
Figure 9B:
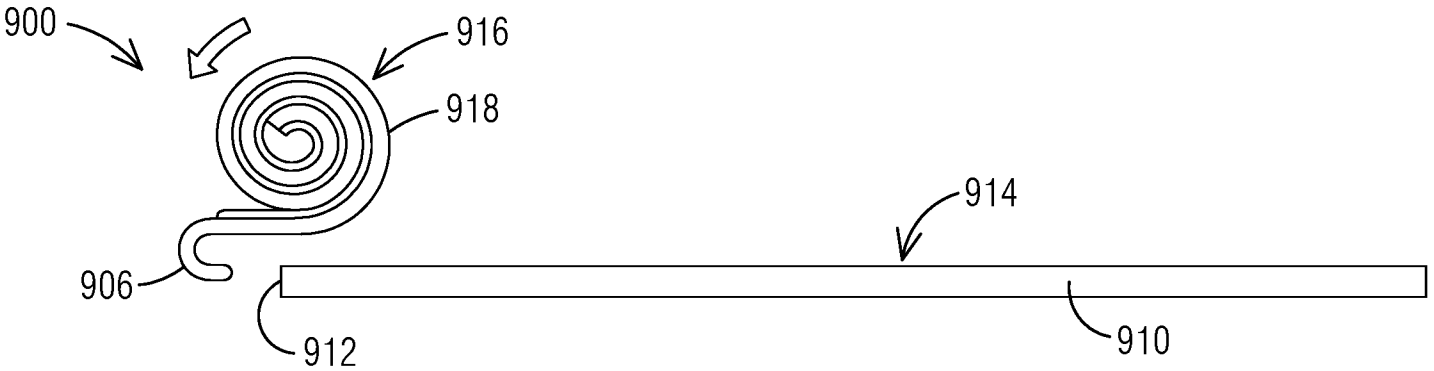

FIG. 9A to FIG. 9B show another alternate example embodiment of a cover assembly 900 that includes a flexible substrate 902, at least one coil spring 904, and at least one connection 906. In this example embodiment, the cover assembly 900 is configured to cover an object 910. Example objects include display screens (e.g., electronic screens), windows (e.g., cockpit, porthole etc.), consoles, and the like. The coil spring 904 can be a bistable coil spring or not. However, a bistable coil spring will hold the flexible substrate 902 flat in the cover fully extended position shown in FIG. 8A. This, in turn, will allow the flexible substrate 902 to rest on a perimeter 912 of the object while being held in place by the connection 906 without applying pressure to a face 914 of the object 910 inside the perimeter 912. Since the flexible substrate 902 does not touch the face 914, the flexible substrate 902 will not scratch the face 914. Instead, the flexible substrate 902 protects the face 914, unlike Bimini covers without such bistable coil spring support which may rub against and thereby scratch the face 914. In this example embodiment, the flexible substrate 902 is coiled into a single coil 916.

While not shown, there may be adjustable side connections between the edges of the flexible substrate 902 and the object 910 or other suitable connection point. These adjustable side connections be configured like the first side connection 840 and the second side connection 842 of the flap 808 of FIG. 8A. Such adjustable side connections would permit infinite adjustment of an amount of reveal of the covered object 910 by holding the coil 916 in any position from left to right (as shown in FIG. 9A and FIG. 9B. Once the coil spring 904 starts to coil, the coil 916 forms with a bottom surface 918 of the flexible substrate 902 facing radially outward. The coil 916 itself acquires its own rigidity and that rigidity would assist in keeping the coil 916 from contacting the face 914.

Figure 9C:
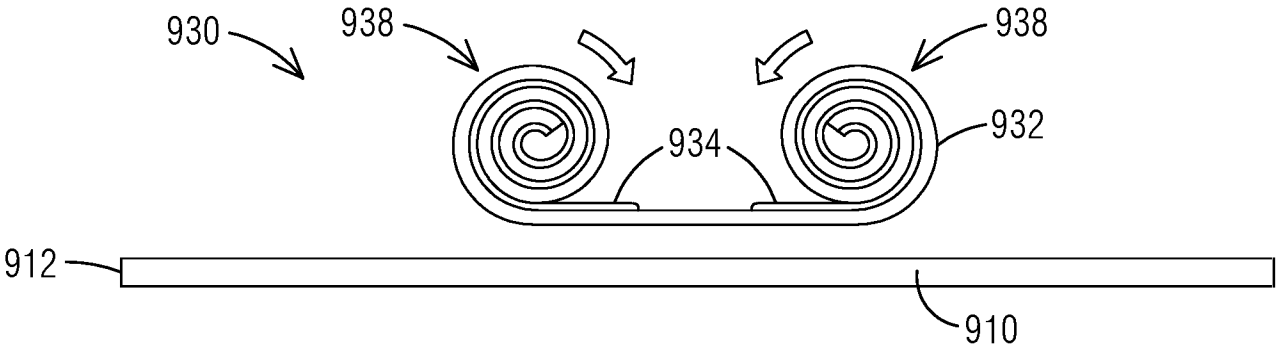

FIG. 9C shows another example embodiment of a cover assembly 930 that includes the flexible substrate 932, at least two coil springs 934, and at least one connection (not visible). The cover assembly 930 accomplishes the same covering/protecting function as does the cover assembly 900 of FIG. 9A and FIG. 9B. However, instead of coiling into one coil, in this example embodiment, the Bimini cover 932 coils into two coils 938 that coil toward each other.

Figure 10B:
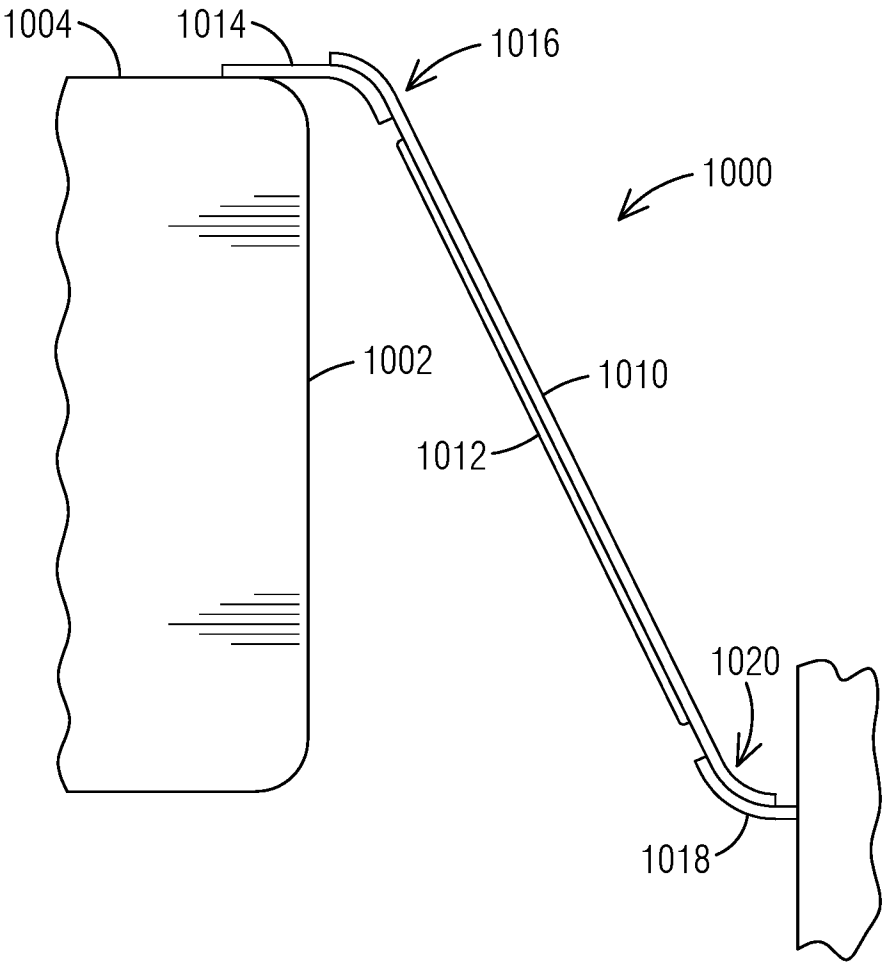
FIG. 10A to FIG. 10B show another alternate example embodiment of a self-coiling barrier.
Figure 10A:
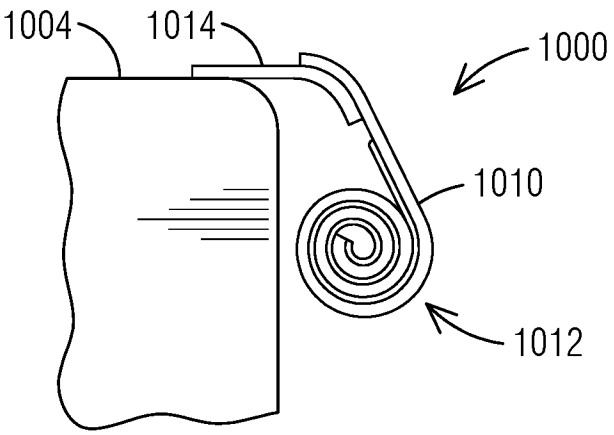

FIG. 10A to FIG. 10B are top views of another alternate example embodiment of a self-coiling barrier embodied as a self-coiling fairing assembly 1000. In this example embodiment, the fairing assembly 1000 is secured to a starboard side 1002 of a center console 1004 of a boat. The fairing assembly 1000 includes a flexible substrate 1010, at least one self-coiling spring 1012, a base connection 1014 that connects a base end 1016 to the center console 1004, and a tip end connection 1018 that connects a tip end 1020 to another structure, such as a gunwale.

In the fairing fully retracted position shown in FIG. 10A, the fairing assembly 1000 is stored out of the way. Although not shown, the fairing assembly 1000 may be stowed in a compartment in the center console 1004. In the fairing fully extended position shown in FIG. 10B, the fairing assembly 1000 is secured in position and can act as a wind barrier that protects the helm from the oncoming wind. The self-coiling spring 1012 may or may not be a bistable coil spring.

While FIG. 10A is disclosed as showing a top view of a fairing, a similar self-coiling barrier could be used as a side barrier. For example, the base end of the self-coiling barrier could be secured to an overhead structure, (e.g., T-Top), and when in the fully extended position, the self-coiling barrier could hang from the overhead structure and provide sun, wind, and/or shade protection from the side.

The present inventor has created a very versatile barrier structure that can be used in a variety of configurations, that provides superior protection, and that mitigates storage problems associated with conventional barriers. Consequently, this represents an improvement in the art.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising:

a Bimini assembly, comprising a fixed portion and a retractable portion;

a coil spring secured to the retractable portion and configured to urge the retractable portion to coil when the coil spring is not in a fully extended position; and a stabilizing feature configured to selectively hold the retractable portion in a retractable portion fully extended position;

wherein the fixed portion comprises a rigid framework; wherein the retractable portion comprises a Bimini cover;

wherein the coil spring comprises the stabilizing feature as part of a design of the coil spring that is configured to lock the coil spring in a coil spring fully extended position once the coil spring is fully extended and to unlock the coil spring from the coil spring fully extended position when the coil spring is forcefully collapsed; and wherein locking the coil spring into the coil spring fully extended position holds the Bimini cover in a Bimini cover fully extended position.

2. The apparatus of claim 1, wherein the stabilizing feature further comprises a connection between a perimeter of the Bimini cover and the rigid framework.

3. An apparatus, comprising:

a rigid frame;

a Bimini cover comprising: a first portion; and a flap assembly that is selectively configurable between a closed configuration and an open configuration in which an amount of shaded area under the Bimini cover is reduced;

wherein the flap assembly comprises a flap of the Bimini cover, a coil spring configured to coil the flap when the coil spring is not in a fully extended position; and a stabilizing feature configured to selectively hold both the coil spring and the flap in a flap fully extended position.

4. The apparatus of claim 3, wherein the stabilizing feature comprises a connection between a perimeter of the flap and the first portion that is configured to overcome a coil force exerted by the coil spring.

5. The apparatus of claim 3, wherein the coil spring comprises the stabilizing feature as part of a design of the coil spring that is configured to lock the coil spring in a coil spring fully extended position once the coil spring is fully extended and to unlock the coil spring from the coil spring fully extended position when the coil spring is forcefully collapsed; and wherein locking the coil spring into the coil spring fully extended position holds the flap in the flap fully extended position.

6. The apparatus of claim 5, wherein the stabilizing feature further comprises a connection between a perimeter of the flap and the first portion.

7. The apparatus of claim 3, wherein in the open configuration the first portion surrounds an opening through the Bimini cover.

8. The apparatus of claim 3, wherein flap is disposed adjacent the first portion; wherein in the closed configuration the Bimini cover defines a closed configuration perimeter; wherein in the open configuration the Bimini cover defines an open configuration perimeter that is different than the closed configuration perimeter.

9. The apparatus of claim 8, wherein the Bimini cover is configured to cover a greater area in the closed configuration than in the open configuration.

10. The apparatus of claim 8, wherein the flap is disposed at leading edge or a trailing edge along a longitudinal axis of the Bimini cover and the coil spring is configured to coil the flap laterally relative to the longitudinal axis.

11. An apparatus, comprising:

a Bimini assembly, comprising a fixed portion and a retractable portion;

a coil spring secured to the retractable portion and configured to urge the retractable portion to coil when the coil spring is not in a fully extended position; and a stabilizing feature configured to selectively hold the retractable portion in a retractable portion fully extended position;

wherein the retractable portion comprises a Bimini flap of a Bimini cover;

wherein the fixed portion comprises a remainder of the Bimini assembly; and wherein the stabilizing feature comprises a connection between the Bimini flap and the remainder of the Bimini assembly.

12. The apparatus of claim 11, wherein the Bimini cover comprises the Bimini flap and a remainder of the Bimini cover, wherein the fixed portion comprises the remainder of the Bimini cover, and wherein the connection is between the Bimini flap and the remainder of the Bimini cover.

13. The apparatus of claim 11, wherein the fixed portion comprises a rigid framework to which the Bimini cover is secured, and wherein the connection is between the Bimini flap and the rigid framework.

14. The apparatus of claim 11, wherein the connection comprises a zipper between the Bimini flap and the remainder of the Bimini assembly.

15. The apparatus of claim 14, wherein the connection creates a water resistant or waterproof seal where a perimeter of the Bimini flap is connected to the remainder of the Bimini assembly.

16. The apparatus of claim 14, wherein the Bimini flap comprises a base toward which the coil spring coils the Bimini flap, a first side connected to the base, and a second side connected to the base; and wherein the zipper comprises a first zipper between the first side and the remainder of the Bimini assembly and a second zipper between the second side and the remainder of the Bimini assembly.

17. The apparatus of claim 16, further comprising a second connection between a tip end of the Bimini flap and the remainder of the Bimini assembly.

18. An apparatus, comprising:

a Bimini assembly, comprising a fixed portion and a retractable portion;

a coil spring secured to the retractable portion and configured to urge the retractable portion to coil when the coil spring is not in a fully extended position; and a stabilizing feature configured to selectively hold the retractable portion in a retractable portion fully extended position;

wherein the retractable portion comprises a Bimini flap of a Bimini cover;

wherein the coil spring comprises the stabilizing feature as part of a design of the coil spring that is configured to lock the coil spring in a coil spring fully extended position once the coil spring is fully extended and to unlock the coil spring from the coil spring fully extended position when the coil spring is forcefully collapsed; and wherein locking the coil spring into the coil spring fully extended position holds the Bimini flap in a Bimini flap fully extended position.

19. The apparatus of claim 18, wherein the Bimini cover comprises a first portion and the Bimini flap, and wherein the stabilizing feature further comprises a connection between a perimeter of the Bimini flap and the first portion of the Bimini cover.

20. An apparatus, comprising:

a Bimini assembly, comprising a fixed portion and a retractable portion;

a coil spring secured to the retractable portion and configured to urge the retractable portion to coil when the coil spring is not in a fully extended position; and a stabilizing feature configured to selectively hold the retractable portion in a retractable portion fully extended position;

wherein the coil spring is configured to form a coil of the retractable portion that moves from a tip end toward a base end as the coil spring coils the retractable portion; and the apparatus further comprising a second coil spring disposed parallel to the coil spring, set back from the tip end, and effective to aid the coil spring in coiling the retractable portion only once the coil reaches the second coil spring.

* * * * *